United States Patent [19]

Ordorika

[11] 4,074,476

[45] Feb. 21, 1978

[54] TUBULAR DWELLING CONSTRUCTION

[76] Inventor: Imanol Ordorika, Cantil No. 175, Jardines del Pedregal, Mexico City, Mexico

[21] Appl. No.: 636,970

[22] Filed: Dec. 2, 1975

Related U.S. Application Data

[63] Continuation of Ser. No. 480,553, June 17, 1974, abandoned.

[51] Int. Cl.[2] ..... E04B 1/348

[52] U.S. Cl. ..... 52/79.2; 52/168; 52/169.1

[58] Field of Search ..... 52/237, 236, 169, 168, 52/79, 79.2, 79.4, 236.2, 236.1, 236.4

[56] References Cited

U.S. PATENT DOCUMENTS

| | | | |
|---|---|---|---|
| 2,166,577 | 7/1939 | Beckins | 52/167 |
| 2,575,474 | 11/1951 | Shadgen | 52/79 |
| 2,645,114 | 7/1953 | Amerikian | 52/236 |
| 3,159,117 | 12/1964 | Rosenfeld | 52/169 |
| 3,302,363 | 2/1967 | Frey | 52/73 |
| 3,514,910 | 6/1970 | Comm | 52/79 |
| 3,529,386 | 9/1970 | Ostendorf | 52/237 |
| 3,613,321 | 10/1911 | Rhorer | 52/79 |

FOREIGN PATENT DOCUMENTS

| | | | |
|---|---|---|---|
| 88,929 | 7/1922 | Austria | 52/169.1 |
| 1,232,626 | 10/1960 | France | 52/79 |
| 850,582 | 12/1939 | France | 52/169 |
| 419,542 | 4/1947 | Italy | 52/169.1 |

*Primary Examiner*—Price C. Faw, Jr.
*Assistant Examiner*—Henry Raduazo
*Attorney, Agent, or Firm*—Cushman, Darby & Cushman

[57] ABSTRACT

A tubular modular unit having an integrally formed outer structure, floor, and ceiling is provided which may be directly supported upon the ground. A plurality of the tubular units may be placed one on top of another in a stacked configuration to provide for a large capacity housing complex. Cylindrical units are disclosed as being the preferred embodiment, wherein sanitary chambers and a water tank are provided interiorly of the unit. End towers which provide lateral support for a stacked configuration of the units are also utilized as a source of water supply and sewage disposal. Tubular units having elliptical, rectangular, etc., cross-sections may also be advantageously used within the principles of the present invention.

10 Claims, 8 Drawing Figures

TUBULAR DWELLING CONSTRUCTION

This is a continuation, of application Ser. No. 480,553 filed June 17, 1974 and now abandoned.

BACKGROUND OF THE INVENTION

A. Field of the Invention

This invention relates to housing construction, and more particularly, to a form of housing which may be economically produced in modular units of tubular form. The tubes may be stacked on top of each other to form a complex of housing units which may provide low cost housing for a large number of individuals. Each housing unit has the outer walls, floor, ceiling and interior walls entirely precast and is a self-supporting shell which requires no special foundation. Also, each housing unit has chambers for storage of water and for disposal of sewage.

In addition to the units being stacked one on top of another, they may also be arranged in columns for even larger capacity housing projects. Arranged at the end of the stacked rows of units are towers with staircases for access to the units. These towers may also provide a source of water along with means for disposing of sewage.

B. Description of the Prior Art

In U.S. Pat. No. 3,716,954, there is disclosed a modular building system which utilizes box-shaped modular units adapted for interconnected assembly and placed in a stacked position. The stacked units are not integrally cast but rather are assembled from a complex of structural members and beams. Also, the units are disclosed as being column supported which requires that upright vertical members must be employed adjacent to each of the stacked units in order for the units to be structurally supported.

Another U.S. Pat. No. of relevance is 3,730,796, which sets forth a method of manufacture for portable housing structures in which a substantially rectangular forming device is produced on a collapsible rotatable mold to construct a shell which forms the outer periphery of a tubular structure. However, there is no disclosure of forming a ceiling or floor integrally with the tubular structure, this patent being directed to forming a structure by means of a rotational method. The integral formation of a ceiling and floor independent of the outer periphery would therefore be impossible. This patent also discloses that the units formed by the rotational method may be arranged one on top of another if required, or adjacent to each other, or in an end-to-end formation. However, there is no disclosure of a means or method for securing the units to each other so that they will not slide off one another.

A multi-level modular building employing tower cores which support plexi-glass or aluminum units is disclosed in U.S. Pat. No. 3,388,512. The units are of generally elliptical cross-section and are arranged in a vertically rising configuration on top of hollow core members which include elevators, stairs, ducts and utilities. There is no disclosure in this patent of the modular units being self-supported or being placed directly upon the ground.

Prefabricated elements of molded material employed in the construction of dwellings are set forth and described in U.S. Pat. No. 3,363,370. Here again, however, the individual units are arranged in a stacked relationship but are not stacked one on top of another. Rather, the units are supported in a vertically rising configuration by means of a plurality of supporting pillars.

SUMMARY OF THE INVENTION

It is, therefore, an object of the present invention to provide a dwelling which has a floor and ceiling integrally cast with a tubular outer structure. The tubular outer structure is self-supporting and may be directly placed upon the ground in a shallow ditch filled with a gravel bed or the like, no further foundation being required. Because the units are self-supporting, they are of structural integrity sufficient to support additional units stacked directly thereupon so that a high rise structure of stacked modular units may be built.

It is a further object of the present invention to provide a tubular modular unit having a chamber for storing water for use in the kitchen, bathroom, etc. The unit also has a chamber for holding sewage or the like which may be transferred to a septic tank or sewage treatment plant.

Another object of the present invention is to provide for a plurality of tubular units to be stacked one on top of another and to be supported at their ends by towers which provide stairways or other means for access to the stacked modular units. The towers have an upper portion providing for water tanks so that water may be fed into the individual stacked units by means of gravitational flow. Also, the towers may be constructed to contain a cistern at a bottom portion thereof for a septic tank or sewage disposal means.

A further object of the present invention is to provide for a plurality of stacked tubular modular units in which air spaces or draft chambers are located around each of the units. Because different temperatures will radiate from each of the units, currents thereby produced will draw out the air from the inside of the units through ventilation openings provided in each of the units. Thus, a relatively simple ventilating system is employed which functions by means of draft chambers.

Yet another object of the present invention is to provide for a tubular modular unit wherein the shell may be adapted for the passage of electrical ducts or the like.

Still another object of the present invention is to provide for a tubular modular unit in which supporting ledges are integrally cast in the exterior of the shell of each unit so that a corresponding ledge on a stacked unit may have a supporting surface for abutment.

Still another object of the present invention is to provide for a tubular modular unit which may have a circular cross-section or an elliptical cross-section. Also, rectangular or other cross-sections could be employed, depending upon the requirements of a particular locale, design or need.

Additional objects of the present invention reside in the specific construction of the exemplary embodiment hereinafter particularly described in the specification and shown in the several drawings.

BRIEF DESCRIPTION OF THE DRAWINGS

Novel features of the tubular dwelling in accordance with the present invention will be more readily understood from a consideration of the following description taken together with the accompanying drawing, in which certain preferred adaptations are illustrated with the various parts thereof identified by suitable reference characters in each of the views, and in which.

DETAILED DESCRIPTION OF THE INVENTION

Figure 1:
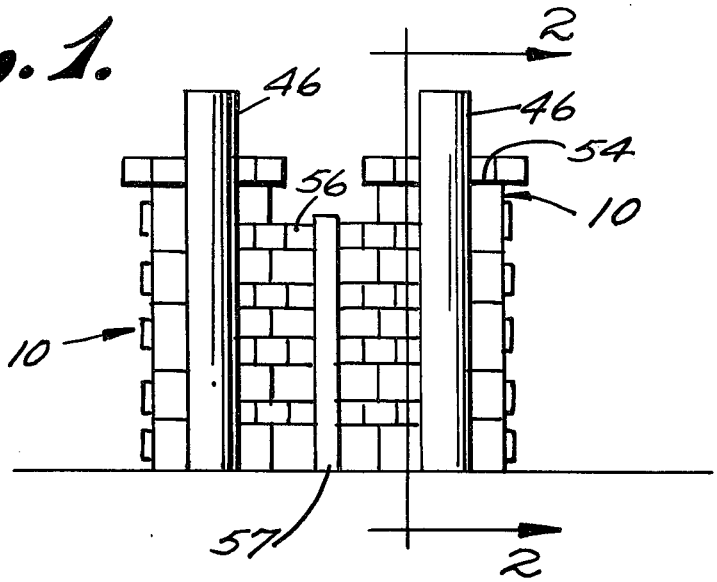
FIG. 1 is a side view of tubular modular units in a stacked configuration and arranged in columns.

The preferred embodiment of the present invention comtemplates a tubular unit of cylindrical cross-sectional shape. From a consideration of FIGS. 1–3, it may be appreciated that the cylindrical tube is especially adapted for use in a housing structure having stacked units. A modular unit, generally designated at 10, may have a cylindrical form in which the floor, ceiling and interior walls are integrally cast with an outer shell. It is contemplated that a tower crane or other device may pour concrete, fiberglass or other structural material into an upright cylindrical molding form. After the material has set, the cylindrical form may be detached and the individual units lowered horizontally to the ground to be subsequently removed to a builing site. The vertical pouring allows for the ceiling, walls and floor to be formed integrally during a single casting operation.

Figure 3:
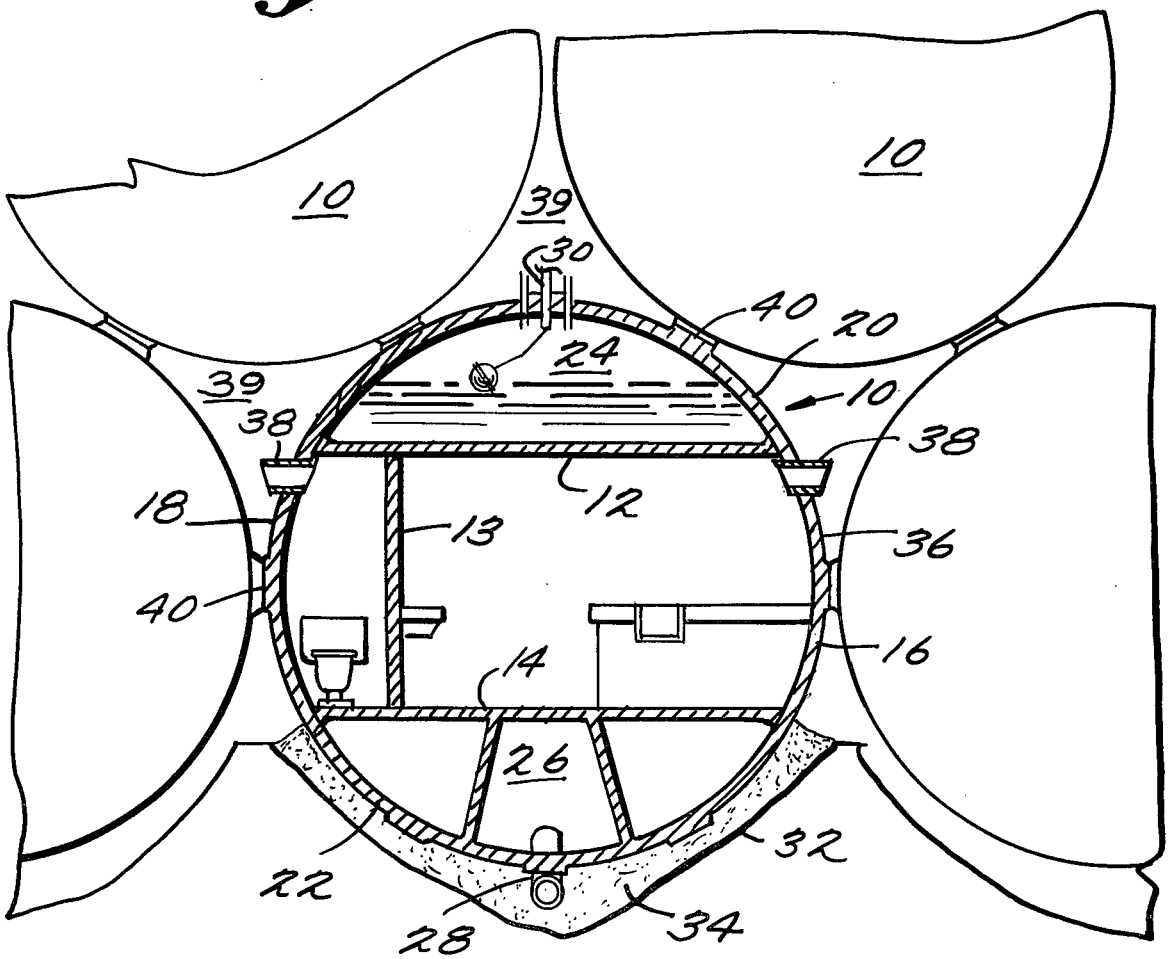
FIG. 3 is a cross-sectional view of an individual tubular modular unit which has a circular cross-section.
Figure 4:
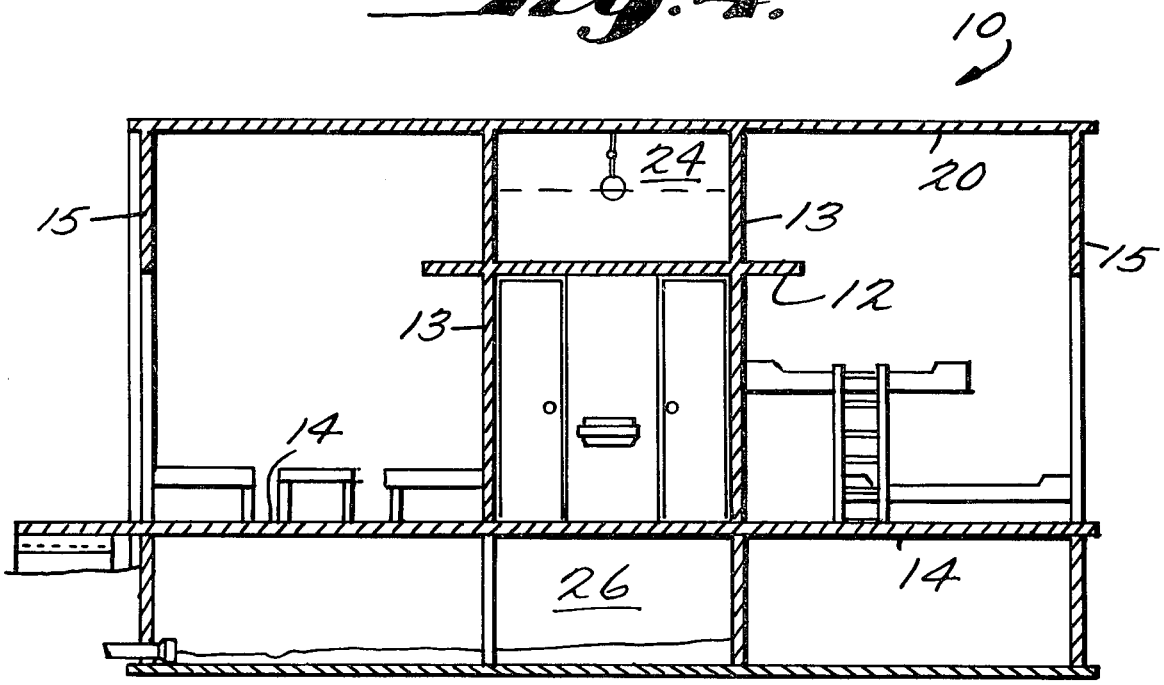
FIG. 4 is a longitudinal section taken along line 4—4 of FIG. 7 and shows a typical interior arrangement.
Figure 5:
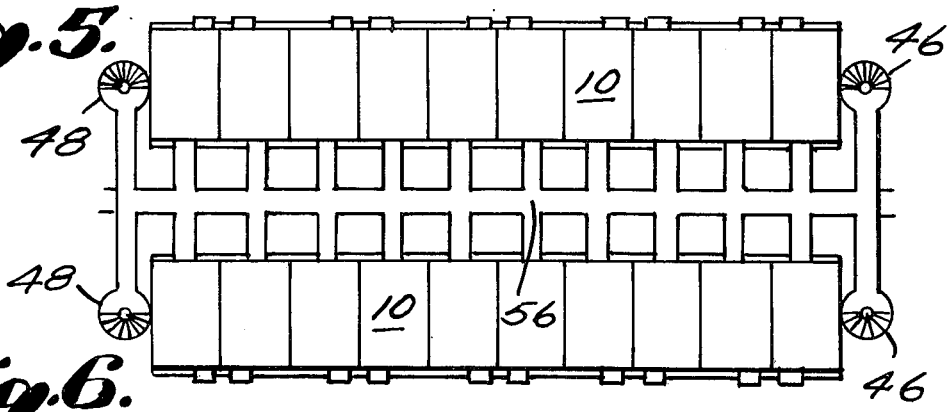
FIG. 5 is a floor plan showing a typical arrangement of tubular modular units which are stacked and arranged in columns.

As can be seen in FIGS. 3 and 4, unit 10 has a ceiling 12, interior wall 13, end walls 15 and a floor 14 which are integrally formed with side walls 16, 18 and upper segment 20 and lower segment 22. At least a portion of upper segment 20 is used with the ceiling 12 to provide for a chamber 24 interior of the unit to enable water or the like to be stored, as may be appreciated from a viewing of FIG. 4. Also, floor 14 and lower segment 22 provide for a lower chamber for receiving and containing sewage or the like. A drain 28 may be provided in lower segment 22 to remove sewage from lower chamber 26. A water feeding inlet 30 also is provided on the upper segment 20 to enable water to be placed in chamber 24 from an external water supply, as from a supporting tower which will be hereinafter described.

In FIG. 3, the modular unit 10 is shown placed within a ditch 32 formed in the ground surface. Because the unit 10 is self-supporting and no foundation is required, only a gravel bed 34 is required between the ground and lower segment 22 of unit 10. Gravel bed 34 prevents excess humidity from forming and also provides correct settlement of a unit or a plurality of units when they are placed in stacked configuration. Internally constructed electrical ducts 36 may be integrally formed in the side walls and also ventilation tubes 38 may be placed in appropriate locations. Supporting ledges 40 are provided on side walls 16 and 18 and upper and lower segments 20 and 22. Supporting ledges 40 enable units 10 to be stacked one on top of another so that the units do not slide or have a tendency to rotate, especially if the units are of cylindrical form. Supporting ledges 40 are contemplated as being integrally formed with the unit 10 in the casting operation, but of course other types of ledges could be attached to provide the same function.

Figure 7:
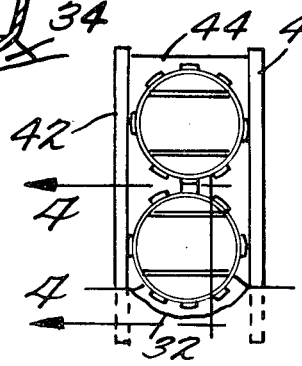
FIG. 7 is an end view illustrating one tubular modular unit stacked on top of another.
Figure 7A:
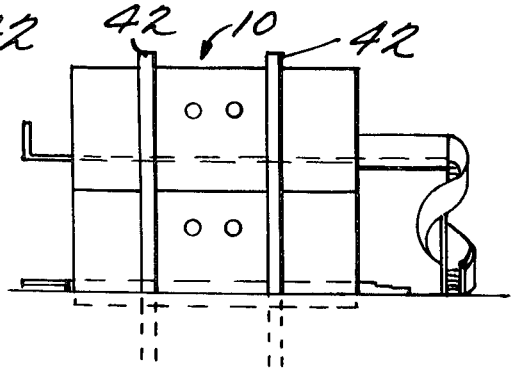
FIG. 7*a* is a longitudinal side view of the stacked units illustrated in FIG. 7.

From a consideration of FIGS. 7 and 7a, it can be seen that if it is desired to stack only a single unit on top of another, one of the units 10 will have a supporting ledge 40 contacting a supporting ledge 40 on the unit beneath it. Such a simple two unit housing structure would have to be supported laterally by guy posts 42. A tensile wire 44 or the like may be required to hold the posts 42 in an upright position. Tensile wire 44 and guy posts 42 provide for lateral support which is needed for a configuration in which only one unit 10 is stacked on top of another unit 10.

Figure 2:
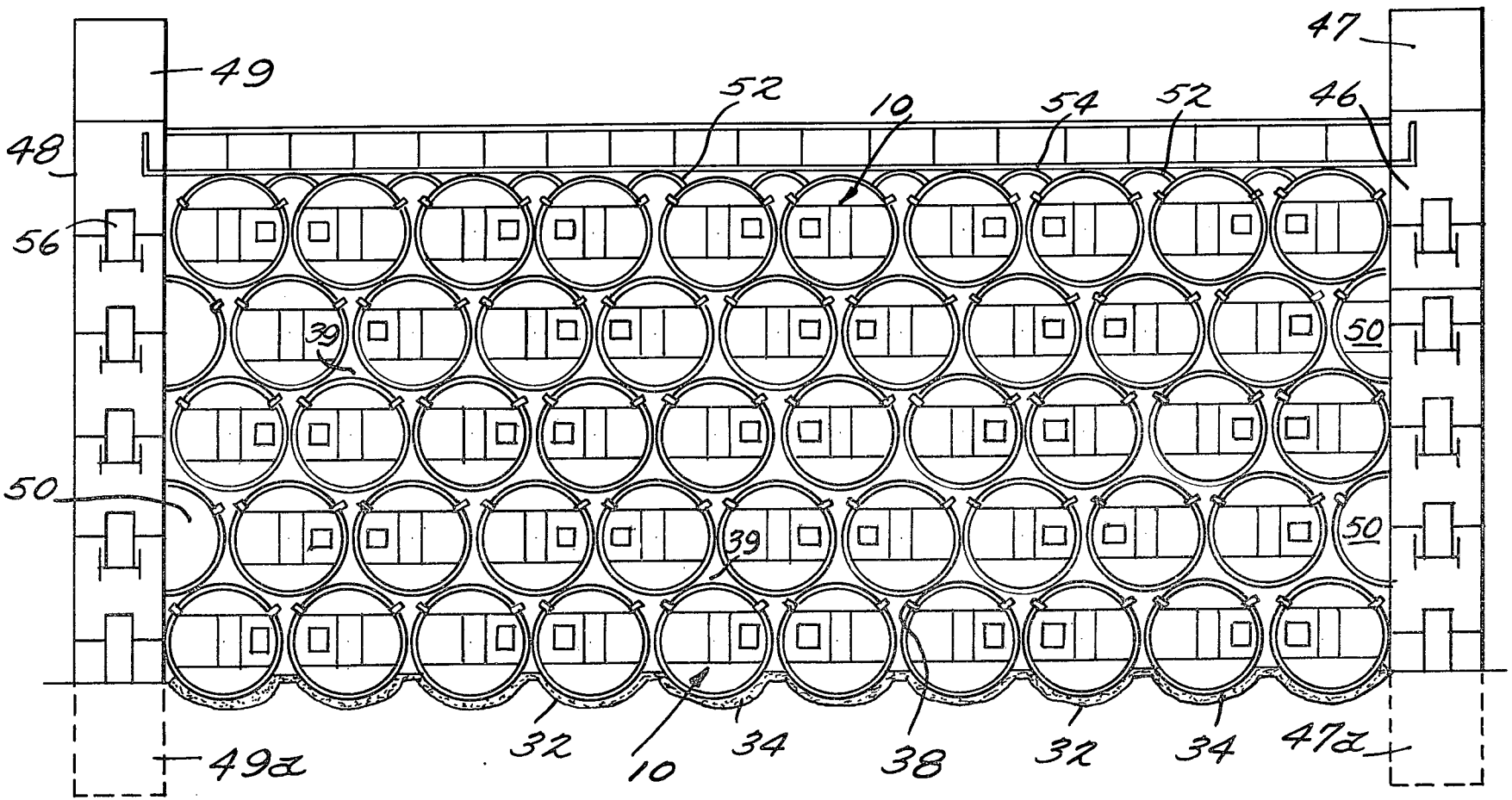
FIG. 2 is a sectional view taken along line 2—2 of FIG. 1.

A preferred use of the tubular units 10 may be appreciated from a viewing of FIG. 2. Here, a plurality of tubular modular units 10 are stacked on top of each other to provide for a high rise housing complex wherein each unit is self-supporting and does not require sanitary installations. Such a high rise or stacked configuration structure may be built by first excavating the ground and preparing a series of ditches depending upon the number of units 10 to be placed in a bottom row of the complex. An end tower 46 is placed in the ground at the location of the end of the first row of units. After the tower 46 and the first row of units are placed in position, a second end tower 48 is then secured in the ground similar to end tower 46. End towers 46 and 48 provide for lateral support of subsequentially added units. A second row of units 10 are then placed upon the first row, each unit of the second row being supported by a pair of units in the first row. The units have corresponding ledges 40 abutting each other as previously described, and which may be seen from a viewing of FIG. 3. Thereafter, additional units 10 are stacked in a similar fashion by a crane or other lifting device. End units 50 are used as complementary rooms in each even-numbered row to fill out the row. End units 50 may be used as laundry rooms, storage rooms, etc.

After the uppermost row has been stacked, precast arches 52 are bridged across and secured to upper segments 20 of the uppermost row. Precast arches 52 along with upper segments 20 provide support for top floor 54. Top floor 54 may be used for a recreational area, clothes lines or storage space. From a further consideration of FIG. 2, it may be seen that when adjacently stacked units 10 have different temperatures inside, currents are produced within draft chambers 39 which draw out the air from the inside of the units through the ventilation openings 38. The air is circulated along the draft chambers 39 existing between the units. In geographical areas where there are high temperatures and humidity, the stacked units may be supported at a greater distance apart from each other by thicker ledges 40 to provide for greater air currents to ventilate the units through draft chambers 39 and ventilation openings 38 by suction. Free circulation of air could also be provided beneath a single tubular unit raised off the ground by means of insulating supports.

End towers 46 and 48, while providing for lateral support of the stacked units 10, also provide for a source of water supply and sewage disposal. End towers 46 and 48 are contemplated as being constructed of concrete poured at the location with sliding forms. Supply tanks 47 and 49 may be integrally constructed at the top of towers 46 and 48, respectively. Supply tanks 47 and 49 may supply water to units 10 by gravitational flow of water through pipes to feeding inlets 30 in upper chambers 24. Sewage from the bathroom and kitchen which flow into lower chamber 26 (see FIG. 4) may be either treated in a septic tank in chamber 26 or may be drained by gravity through individual drain pipes 28 into cisterns 47*a* and 49*a* located in a bottom section of towers 46 and 48, respectively. Sewage may be transported to sewage treatment plants or the like for proper treatment from cisterns 47*a* and 49*a*. End towers 46 and 48 also provide for stairways which lead to each individual unit 10. Bridge passageways 56 may also be provided from the towers to lead from one column of stacked units to another column of stacked units, or from a central staircase 57, as may be seen from a viewing of FIGS. 1 and 2.

Figure 6:
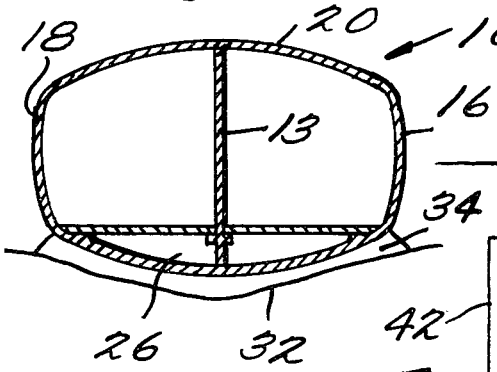
FIG. 6 is a view of a modular unit having an elliptical cross-section.

As has been previously described, a cylindrical modular unit is the preferred construction, but other shapes may also be advantageously employed. For instance, from FIG. 6, it may be appreciated that a unit having an elliptical cross-section provides for a pleasing appearance and may be provided with the same features as the cylindrical units 10. It is also contemplated that the elliptical unit could be placed vertically so as to provide for a more upright structure.

While it is contemplated that the units will be constructed of concrete, materials such as fiberglass or other structurally rigid materials could also be readily employed as particular requirements dictate.

Having illustrated and described what is presently a preferred form of the invention, it should be apparent to those persons skilled in the art that the same permits of modification in arrangement and detail. I claim as my invention all such modifications as come within the true spirit and scope of the appended claims.

What is claimed is:

1. A plurality of tubular dwellings arranged in a stacked configuration, each of said dwellings have side walls integrally cast with an upper segment and a lower segment to form a self-supporting modular unit, each of said units comprising:

a. an interior floor and ceiling also integrally cast or formed with said side walls and said upper and lower segments, at least a portion of ceiling and said upper segment providing for an upper internal chamber for containing water or the like, said floor and said lower segment providing for a lower internal chamber for containing sewage or the like;

b. means arranged on said upper segment for feeding water or the like through an inlet into said upper internal chamber;

c. means arranged on said lower segment for draining sewage or the like from said lower internal chamber; and d. a plurality of supporting ledges disposed along an exterior surface of said unit;

wherein a first bottom row of said units are placed side-by-side, said units being supported upon a foundation of a gravel bed or the like in a plurality of ditches in the ground, at least a second and a third row of said units being stacked upon said first row, each of the even-numbered rows being provided at both ends thereof with complementary rooms which complete said even-numbered rooms, wherein each unit in said second row is supported by two of said units in said first row, said ledges of each of said units in said second row abutting against corresponding ledges on said two units in said first row, wherein means for providing lateral support are arranged proximate to said units to secure said units in a stacked configuration said means comprising a tower adjacent to each end of said rows, each of said towers being embedded into the ground, the arrangement including precast arches bridged across the upper segments of each side-by-side unit in the uppermost row of said stacked configuration, and an upper floor disposed against said precast arches and against said upper segments of said uppermost row of units, each of said units being provided with a ventilating means.

2. The plurality of tubular dwellings arranged in a stacked configuration as described in claim 1 wherein precast arches are bridged across the upper segments of each side-by-side unit in an uppermost row of said stacked configuration, wherein an upper floor is disposed against said precast arches and said upper segments of said uppermost row of units, each of said units being provided with a ventilating means.

3. The plurality of tubular dwellings arranged in a stacked configuration as described in claim 1 wherein each of said towers comprises a water tank adapted to supply water to said units, and also comprises a cistern adapted to receive sewage or the like from said units.

4. The plurality of tubular dwellings arranged in a stacked configuration as described in claim 3 wherein said towers provide support for stairways which lead to each individual unit.

5. The plurality of tubular dwellings arranged in a stacked configuration as described in claim 3 wherein at least two columns of said stacked rows are arranged adjacently, each of said columns having a tower disposed at the ends of said rows, wherein said towers provide support for stairways which lead to each individual unit, said stairways providing access from units in one column to units in the other column.

6. The plurality of tubular dwellings arranged in a stacked configuration as described in claim 4 wherein means for ventilating said units are provided in each of said units.

7. A plurality of tubular dwellings disposed with their axes horizontal and arranged in engagement with each other in a plurality of horizontal rows stacked one on top of another with each row being supported by the next lower row, each of said dwellings having a continuous side, bottom and top wall which is curved with respect to the axis of the dwelling whereby horizontal passages extending transverse to the axes of the dwellings are formed between dwellings; means forming a ventilation passage from each dwelling into at least one of said horizontal passages; a horizontal roof structure supported on the uppermost now of dwellings; and at least one vertical tower disposed at the end of each row of dwellings, each tower being embedded at its lower end in the ground and having a sidewall providing lateral support for the rows of dwellings.

8. A building comprising two groups of stacked tubular dwellings as in claim 7, said groups being arranged in spaced-apart parallel coextensive relationship such that the ends of the tubular dwellings in one group face the ends of the tubular dwellings in the other group, said building including horizontal pedestrian bridges at the level of each row connecting the ends of the dwellings in a row in one group with the ends of the dwellings in the corresponding row in the other group.

9. A plurality of stacked tubular dwellings as in claim 7 wherein at least one of said towers includes an integral co-axial water tank at its upper end for supplying water by gravity to the dwellings and an integral co-axial cistern at its lower end for receiving sewage from the dwellings.

10. A plurality of stacked tubular dwellings as in claim 7 wherein said roof structure is disposed on a plurality of precast arches which are bridged across the curved top walls of adjacent dwellings in the top row.

* * * * *